United States Patent [19]

Ammon et al.

[11] Patent Number: 4,940,404

[45] Date of Patent: Jul. 10, 1990

[54] METHOD OF MAKING A HIGH VELOCITY ARMOR PENETRATOR

[75] Inventors: Robert L. Ammon, Baldwin; Raymond W. Buckman, Jr., Pleasant Hills; Ram Bajaj, Greensburg, all of Pa.

[73] Assignee: Westinghouse Electric Corp., Pittsburgh, Pa.

[21] Appl. No.: 337,604

[22] Filed: Apr. 13, 1989

[51] Int. Cl.[5] ..... B22F 3/24

[52] U.S. Cl. ..... 419/28; 75/248; 102/501; 102/517; 419/31; 419/32; 419/41; 419/48; 419/60; 419/67

[58] Field of Search ..... 102/501, 517; 75/248; 419/41, 48, 67, 28, 31, 32, 60

[56] References Cited

U.S. PATENT DOCUMENTS

| | | | |
|---|---|---|---|
| 3,946,673 | 3/1976 | Hayes | 102/52 |
| 4,458,599 | 7/1984 | Mullendore et al. | 102/517 |
| 4,665,828 | 5/1987 | Auer | 102/519 |
| 4,760,794 | 8/1988 | Allen | 102/473 |

*Primary Examiner*—Stephen J. Lechert, Jr.
*Attorney, Agent, or Firm*—Fred J. Baehr, Jr.

[57] ABSTRACT

A method of making a tungsten tantalum material comprising generally 80 percent by weight tungsten and 20 percent by weight tantalum and forming the material into a high strength full density round bar, which can be utilized in a high velocity armor penetrator.

9 Claims, 1 Drawing Sheet

METHOD OF MAKING A HIGH VELOCITY ARMOR PENETRATOR

BACKGROUND OF THE INVENTION

The invention relates to an armor penetrator and more particularly to a high velocity, tantalum-tungsten, armor penetrator and a method of making such a penetrator.

The standard U.S. Army anti-armor or armor penetrator material is a liquid phase sintered tungsten, iron nickel copper material, W, Fe, Ni, Cu, which is formed from blended powders that are isostatically pressed and sintered at elevated temperature to produce a fully dense material. The sintered material is then processed into a round bar of the appropriate diameter by any one or combination of standard metal working operations to form the desired armor penetrator which can vary in size from about 7.5 to 25 millimeters in diameter with a length to diameter ratio of about 15 to 20:1 depending on the application.

Improvements in potential enemy armor plating and tank design have necessitated improvements in the U.S. Army's anti armor material capability. To defeat the potential enemy's improved armor and tank design, higher launch velocities and improved penetrating capabilities are required. The higher launch velocities and improved penetrating requirements are beyond the capability of the current reference liquid phase sintered tungsten material M735. Materials with higher strength to withstand launch stresses are required along with maintaining high density and minimizing metallurgical interaction between the armor and the projectile.

SUMMARY OF THE INVENTION

Among the objects of the invention may be noted the provision of high density, high tensile strength, hard material which will withstand the stresses of high launch velocities.

In general, a high velocity armor penetrator, when made in accordance with the method described in this invention comprises the steps of: blending powdered tungsten and powdered tantalum; encapsulating the blended powder in a metal canister; degassing the blended powder in the canister at an elevated temperature by evacuation; sealing the evacuated canister; and extruding the canister through dies at a higher elevated temperature to produce a metal clad bar of fully dense tungsten, tantalum, which when further machined or worked will form a dense, hard armor penetrator with high tensile strength and melting point and one that will minimize metallurgically interaction with the armor.

BRIEF DESCRIPTION OF THE DRAWINGS

The invention as set forth in the claims will become more apparent by reading the following detailed description in conjunction with the accompanying drawing in which:

DESCRIPTION OF THE PREFERRED EMBODIMENT

Figure 1:
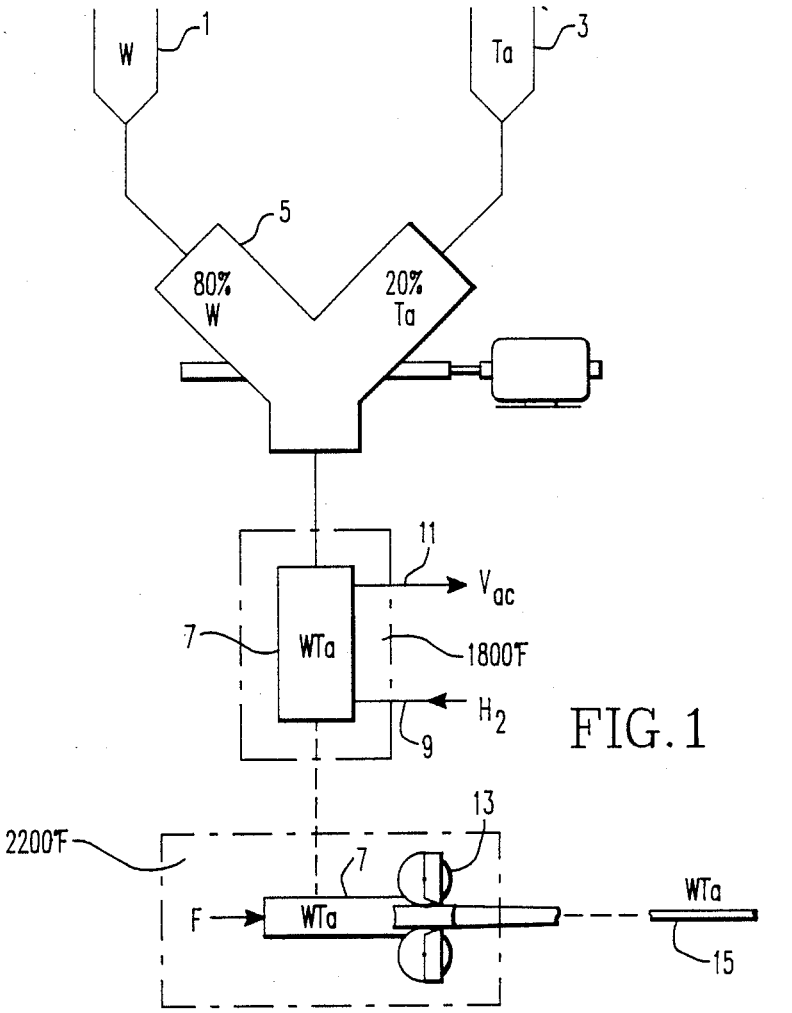
FIG. 1 is a schematic representation of the process utilized to make a high velocity armor penetrator.

Referring now to the drawings in detail and in particular to FIG. 1 there is shown a process or method of making a tungsten tantalum high velocity armor penetrator, which comprises the steps of: supplying powdered tungsten from a hopper and tantalum from a hopper 3 to a blender 5 wherein tungsten and tantalum are thoroughly blended preferably in a ratio of 80 percent by weight of tungsten, W, to 20 percent by weight of tantalum, Ta. While 20 percent tantalum produced very good properties, it is understood that variations generally in the range of plus 3 percent and minus 5 percent will also provide an improved armor penetrator. The blended tungsten, tantalum, WTa, is placed in a metal or steel canister 7 having inlet and outlet ports 9 and 11, respectively, which are connected to a hydrogen, $H_2$, source and a vacuum to facilitate hydrogen degassing at an elevated temperature of about 1800° F. The evacuated canister 7 is sealed and heated to about 2200° F. and extruded using a Dynapak high energy extruding machine 13 to provide a fully dense round bar with steel cladding the outer periphery of the fully dense WTa bar. The WTa bar is hot swaged to about one half its original diameter or less at about 1300° F. to fully develop a bar 15 with the desired physical properties. Additional hot working or further reduction in diameter to about 1/7 of its original fully dense diameter may be required to improve the elongation. When penetrating armor the WTa bar 15 will provide minimum interaction with the armor as it will not alloy with the armor as much as the M735 material will.

Following is a table comparing the properties of M735 a material presently used as an armor penetrator and the tungsten tantalum WTa material or bar 15 made in accordance with this invention.

| | M735 | WTa* | WTa** |
|---|---|---|---|
| Composition Wt % | 97W, 1.4–1.5Ni 0.7–1.1Fe + Cu + Co | 80W, 20Ta | 80W,20Ta |
| Density, Gm/cm$^3$ | 18.6 | 18.8 | 18.8 |
| Tensile Strength Ksi | 156–166 | 260 | 258 |
| Yield Strength Ksi | 155–159 | 254 | 243 |
| Elongation % | 0.6–1.6 | 0.4 | 2.5*** |
| Hardness DPH | 365–385 | 575 | — |
| Melting Point °F. | ~2400 | >5400 | >5400 |

Figure 2:
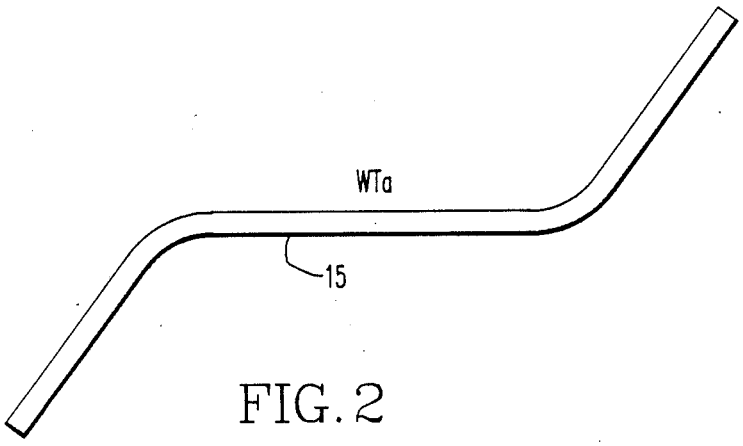
FIG. 2 shows how a ⅛ inch bar of the penetrator was bent at room temperature.

WTa* Swaged to ~½ of fully dense formed diameter.
WTa** Swaged to ~1/7 of fully dense formed diameter.
***WTa is a composite and tensile elongation behavior is not the same as for a monolithic material. An example of the excellent room temperature ductility is shown in FIG. 2 which shows the extent to which a ⅛ inch diameter rod was bent at room temperature with out failure.

The swaged tungsten tantalum, WTa, formed by the method described herein advantageously produces a high velocity armor penetrator which has high density, tensile strength and hardness so as to be able to withstand the high launch stresses associated with the high velocities required to defeat improved armor and tank designs.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of this invention.

What is claimed is:

1. A method of making a high velocity armor penetrator material comprising the steps of:

blending powdered tungsten and powdered tantalum;

encapsulating the blended powder in a metal canister;

degassing the blended powder in the canister at an elevated temperature by evacuation;

sealing the evacuated canister; and extruding the canister through dies at a higher elevated temperature to produce a metal clad bar of fully dense tungsten - tantalum.

2. The method of making a high velocity armor penetrator material as set forth in claim 1, wherein the step of blending powdered tungsten and powdered tantalum comprises blending generally 80 percent by weight of tungsten and 20 percent by weight of tantalum.

3. The method of making a high velocity armor penetrator material as set forth in claim 1, wherein the step of degassing the blended powder in the canister at elevated temperature comprises degassing at a temperature in the range of 1800° F.

4. The method of making a high velocity armor penetrator material as set forth in claim 1, wherein the step of extruding the canister through dies at a higher elevated temperature comprises extruding at a temperature in the range of 2200° F.

5. The method of making a high velocity armor penetrator material as set forth in claim 1, wherein the step of encapsulating the blended powder in a metal canister comprises encapsulating the blended powder in a steel canister.

6. The method of making a high velocity armor penetrator material as set forth in claim 1, wherein the step of encapsulating the blended powder in a metal canister comprises encapsulating the blended powder in a steel canister with inlet and outlet ports to permit hydrogen degassing.

7. The method of making a high velocity armor penetrator material as set forth in claim 6, and further comprising the step of sealing the evacuated canister and extruding the evacuated canister through dies at a temperature of 2200° F. to form a fully dense encapsulated bar of tungsten - tantalum.

8. The method of making a high velocity armor penetrator material as set forth in claim 1 and further comprising the steps of removing the metal canister from the fully dense tungsten -tantalum bar and hot swaging the tungsten -tantalum bar at a temperature of 1300° F. to a reduced diameter.

9. The method of making a high velocity armor penetrator material as set forth in claim 8 wherein the swaging reduces the diameter in the range of half of the original diameter.

* * * * *